US012543912B2

(12) United States Patent
Dodgson

(10) Patent No.: US 12,543,912 B2
(45) Date of Patent: Feb. 10, 2026

(54) FLOOR CLEANER DOCK

(71) Applicant: Dyson Technology Limited, Wiltshire (GB)

(72) Inventor: Oliver Dodgson, Swindon (GB)

(73) Assignee: Dyson Technology Limited, Malmesbury (GB)

( * ) Notice: Subject to any disclaimer, the term of this patent is extended or adjusted under 35 U.S.C. 154(b) by 331 days.

(21) Appl. No.: 18/266,966

(22) PCT Filed: Nov. 24, 2021

(86) PCT No.: PCT/GB2021/053041
§ 371 (c)(1),
(2) Date: Jun. 13, 2023

(87) PCT Pub. No.: WO2022/129859
PCT Pub. Date: Jun. 23, 2022

(65) Prior Publication Data

US 2024/0099537 A1 Mar. 28, 2024

(30) Foreign Application Priority Data

Dec. 17, 2020 (GB) ..... 2019975

(51) Int. Cl.
*A47L 11/40* (2006.01)

(52) U.S. Cl.
CPC ..... *A47L 11/4091* (2013.01); *A47L 11/4083* (2013.01); *A47L 2201/022* (2013.01)

(58) Field of Classification Search
CPC ..... A47L 11/4091; A47L 11/4083; A47L 2201/028; A47L 2201/022
See application file for complete search history.

(56) References Cited

U.S. PATENT DOCUMENTS

| | | | |
|---|---|---|---|
| 5,959,423 | A | 9/1999 | Nakanishi et al. |
| 9,119,518 | B2 | 9/2015 | Hruby |
| 10,111,570 | B2 | 10/2018 | Scholten et al. |
| 2006/0130272 | A1 | 6/2006 | Oh et al. |
| 2006/0140703 | A1 | 6/2006 | Sacks |
| 2013/0232713 | A1 | 9/2013 | Luedke et al. |
| 2015/0297052 | A1 | 10/2015 | Eidmohammadi et al. |
| 2018/0192845 | A1 | 7/2018 | Gu et al. |
| 2018/0344112 | A1 | 12/2018 | Krebs et al. |

(Continued)

FOREIGN PATENT DOCUMENTS

| | | | |
|---|---|---|---|
| CN | 103369996 | A | 10/2013 |
| CN | 204071971 | U | 1/2015 |

(Continued)

OTHER PUBLICATIONS

International Search Report and Written Opinion received for PCT Patent Application No. PCT/GB2021/052974, mailed on Feb. 23, 2022, 10 pages.

(Continued)

*Primary Examiner* — Andrew A Horton
(74) *Attorney, Agent, or Firm* — Tucker Ellis LLP

(57) ABSTRACT

A dock for a floor cleaner is provided. The dock includes a receiving unit for receiving the floor cleaner, and a reservoir for containing liquid. A nozzle is arranged to spray a floor cleaner received in the receiving unit with liquid from the reservoir such that an agitating cleaning effect is provided.

8 Claims, 3 Drawing Sheets

(56) References Cited

U.S. PATENT DOCUMENTS

| | | | | |
|---|---|---|---|---|
| 2018/0344114 | A1 | 12/2018 | Scholten et al. | |
| 2019/0254495 | A1 | 8/2019 | Zhang | |
| 2020/0077858 | A1 | 3/2020 | Zhang et al. | |
| 2020/0121153 | A1* | 4/2020 | Letsky | A47L 9/2873 |
| 2020/0196817 | A1 | 6/2020 | Fang | |
| 2020/0214526 | A1* | 7/2020 | Huang | A47L 11/4088 |
| 2020/0241508 | A1 | 7/2020 | Salmon et al. | |
| 2020/0297179 | A1* | 9/2020 | Fang | A47L 11/4069 |
| 2020/0337513 | A1* | 10/2020 | Johnson | A47L 11/4041 |

FOREIGN PATENT DOCUMENTS

| | | | |
|---|---|---|---|
| CN | 110916579 | A | 3/2020 |
| CN | 111407191 | A | 7/2020 |
| CN | 111493768 | A | 8/2020 |
| CN | 111568325 | A | 8/2020 |
| CN | 108577696 | B | 9/2020 |
| CN | 211723028 | U | 10/2020 |
| CN | 211911505 | U | 11/2020 |
| CN | 212015459 | U | 11/2020 |
| CN | 112006614 | A | 12/2020 |
| CN | 112006615 | A | 12/2020 |
| CN | 112006618 | A | 12/2020 |
| CN | 112022013 | A | 12/2020 |
| CN | 212037389 | U | 12/2020 |
| DE | 202016104067 | U1 | 10/2017 |
| DE | 102019109298 | A1 | 10/2020 |
| EP | 2436296 | A1 | 4/2012 |
| EP | 2636353 | A2 | 9/2013 |
| EP | 3095370 | A1 | 11/2016 |
| EP | 3284382 | A2 | 2/2018 |
| EP | 3711649 | A1 | 9/2020 |
| GB | 0389285 | A | 3/1933 |
| JP | 2590544 | B2 | 3/1997 |
| KR | 10-2001-0087031 | A | 9/2001 |
| WO | 97/49528 | A1 | 12/1997 |
| WO | 2019/038188 | A1 | 2/2019 |
| WO | 2020/143291 | A1 | 7/2020 |

OTHER PUBLICATIONS

International Search Report and Written Opinion received for PCT Patent Application No. PCT/GB2021/052975, mailed on Mar. 1, 2022, 12 pages.

International Search Report and Written Opinion received for PCT Patent Application No. PCT/GB2021/052976, mailed on Mar. 1, 2022, 11 pages.

International Search Report and Written Opinion received for PCT Patent Application No. PCT/GB2021/053041, mailed on Mar. 1, 2022, 11 pages.

Search Report received for GB Application No. 2019977.4, mailed on May 27, 2021, 1 page.

Search Report received for GB Application No. 2019980.8, mailed on May 27, 2021, 1 page.

Search Report received for GB Application No. 2019982.4, mailed on May 14, 2021, 2 pages.

Search Report received for GB Application No. 2301500.1, mailed on Mar. 22, 2023, 1 page.

* cited by examiner

FLOOR CLEANER DOCK

CROSS-REFERENCE TO PRIOR APPLICATION

This application is a § 371 National Stage Application of PCT International Application No. PCT/GB2021/053041 filed Nov. 24, 2021, which claims the priority of United Kingdom Application No. 2019975.8, filed Dec. 17, 2020, each of which are herein incorporated by reference in their entirety.

FIELD OF THE INVENTION

This invention relates to a dock for a floor cleaner. More particularly, but not exclusively, this invention relates to a dock for cleaning a floor cleaner.

BACKGROUND OF THE INVENTION

Various types of floor cleaner are available. They include "dry" floor cleaners such as vacuum cleaners, and "wet" floor cleaners. Wet floor cleaners apply a cleaning fluid to the floor as part of the cleaning process. Wet floor cleaners often include a reservoir for holding cleaning fluid, means by which to apply the cleaning fluid to the floor, cleaning pads arranged to be in contact with the floor and for agitating the cleaning fluid once applied to the floor, and potentially a waste liquid reservoir for receiving waste liquid, i.e. the cleaning fluid once it has been in contact with the floor and agitated by the cleaning pads. The wet floor cleaner may also comprise at least one flexible blade, or squeegee, to help contain the cleaning fluid in the cleaning area during the cleaning process. The wet floor cleaner will also often contain a power source, for example a rechargeable battery, which powers some or all of: the application of cleaning fluid to the floor; driving the cleaning pads to agitate the cleaning fluid in contact with the floor; and removing the waste liquid into the waste liquid reservoir as required.

As such, floor cleaners, and in particular wet floor cleaners, may have several service requirements, including but not limited to: refilling cleaning fluid; emptying waste fluid; recharging the power source; conditioning the cleaning pads; and general cleaning and sanitising of the floor cleaner. The present invention seeks to address at least some of these service requirements.

SUMMARY OF THE INVENTION

According to a first aspect, the invention provides a dock for receiving a floor cleaner, the dock comprising: a receiving unit for receiving the floor cleaner, a reservoir for containing liquid, and a nozzle arranged to spray a floor cleaner received in the receiving unit with liquid from the reservoir such that an agitating cleaning effect is provided.

The invention provides a convenient way to clean a floor cleaner during or after use. By providing a convenient way to clean a floor cleaner, hygiene may be improved and the potential for bad odours to develop over time may be reduced or removed. Additionally, by cleaning the floor cleaner during or after use, it may reduce or remove the need to replace floor cleaner components that would otherwise become contaminated during use, to a point where they needed replacement.

The nozzle may be arranged to spray liquid such that the liquid exits the nozzle at a speed of at least 5 m/s, for instance at least 10 m/s, at least 20 m/s, at least 40 m/s or at least 100 m/s.

The dock may be arranged such that the liquid sprayed on the floor cleaner returns to the reservoir for containing liquid. Recycling the liquid in such a way may improve the environmental performance of the dock.

The dock may further comprise a waste liquid reservoir for receiving the liquid sprayed on the floor cleaner. Such an arrangement may improve the hygiene of the dock, by ensuring any contaminated liquid is removed from the cleaning process.

The dock may further comprise a heater, the heater arranged to heat the liquid being sprayed on the floor cleaner. Such an arrangement may improve the cleaning efficiency of the dock.

The dock may further comprise a filter, the filter arranged to filter liquid that has been sprayed onto the floor cleaner. Such an arrangement may improve the hygiene of the dock by removing contaminants from the liquid being used in the cleaning process, whilst still allowing the liquid to be recycled and improving the environmental performance of the dock.

The spray may be arranged for intermittent operation, such that the floor cleaner may be sprayed on a plurality of occasions during a cleaning process.

The spray may be arranged for continuous operation, such that the floor cleaner is sprayed for an extended time during a cleaning process.

The dock may further comprise a charging unit, the charging unit arranged to charge a battery of a floor cleaner received in the receiving unit.

The dock may further comprising a cleaning fluid reservoir for supplying cleaning fluid to a floor cleaner received in the receiving unit.

According to a second aspect, the invention provides a dock as described with reference to the first aspect of the invention, and a floor cleaner. The floor cleaner may be received in the receiving unit of the floor cleaner. The floor cleaner may comprise any of the features described with respect to the floor cleaner which may be received in the receiving unit of the dock of the first aspect of the invention.

According to a third aspect, the invention provides a method of cleaning a floor cleaner comprising the steps of: docking the floor cleaner with the dock as described with reference to the first aspect of the invention such that the floor cleaner is received in the receiving unit of the dock, and spraying the floor cleaner with liquid from the reservoir such that an agitating cleaning effect is provided.

It will of course be appreciated that features described in relation to one aspect of the present invention may be incorporated into other aspects of the present invention. For example, the method of the invention may incorporate any of the features described with reference to the apparatus of the invention and vice versa.

DESCRIPTION OF THE DRAWINGS

Embodiments of the present invention will now be described by way of example only with reference to the accompanying schematic drawings of which.

DETAILED DESCRIPTION

Figure 1:
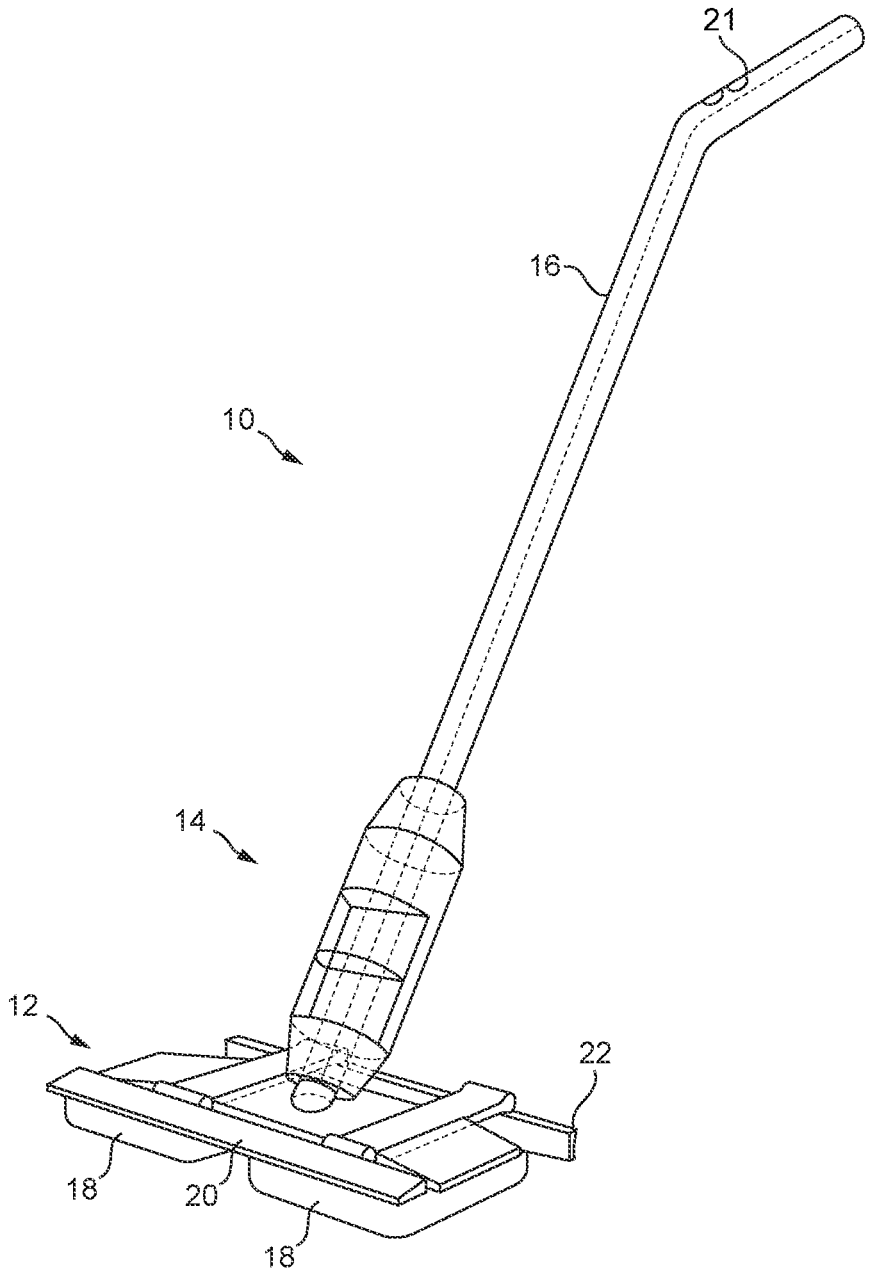
FIG. 1 shows a schematic view of a floor cleaner.

FIG. 1 shows a floor cleaner 10, which comprises a cleaning head 12, a body 14 pivotally attached to the cleaning head 12, and a handle 16 extending away from the body 14. The cleaning head 12 comprises two cleaning pads 18, which are arranged to contact a floor and oscillate during use, and a front squeegee 20 and rear squeegee 22, respectively positioned in front of and behind the cleaning pads 18. The terms "front" and "rear" will be understood by the skilled person to mean the front and rear of the cleaning head 12 when the floor cleaner 10 is being used by a user. In FIG. 1, the front squeegee 20 is shown in a retracted position, and may also be folded down into a deployed position, in which the front squeegee 20 makes contact with the floor. The body 14 comprises a cleaning fluid reservoir, a waste fluid reservoir, and a battery (not shown). The cleaning fluid reservoir is arranged to hold cleaning fluid and apply the cleaning fluid to the floor during use of the floor cleaner 10. The cleaning pads 18 oscillate during use of the floor cleaner, thereby agitating the cleaning fluid on the floor, providing a cleaning effect. The cleaning fluid becomes dirty during agitation, and the waste liquid reservoir is arranged to suck up and store the waste liquid during use of the floor cleaner. The battery is arranged to power the application of cleaning fluid to the floor, the oscillation of the cleaning pads 20, and the sucking up of the waste liquid. The handle 16 comprises a user interface 21 which turns on and off the floor cleaner functions.

Figure 2:
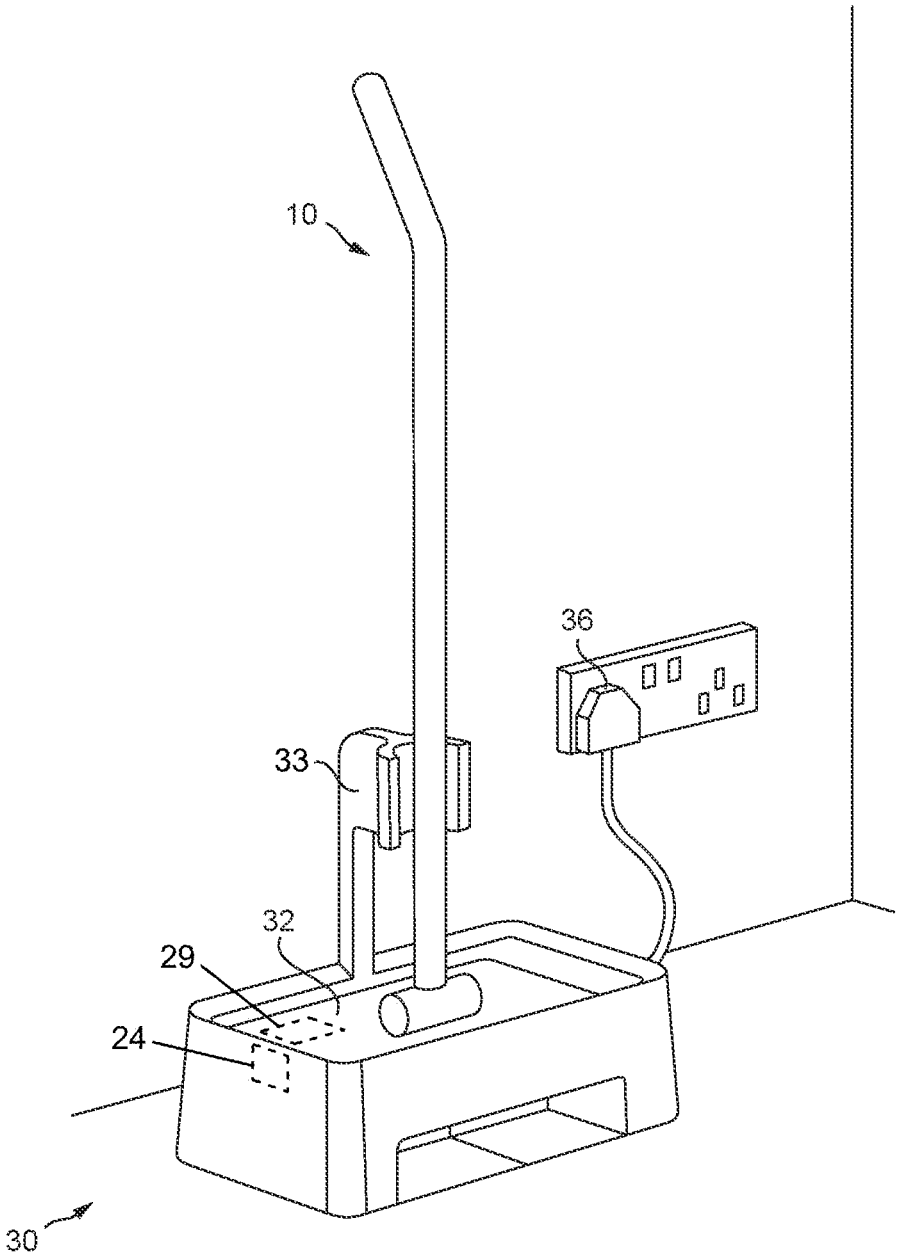
FIG. 2 shows a schematic view of a floor cleaner and dock.

FIG. 2 shows a floor cleaner 10 and a dock 30. The dock 30 comprises a receiving unit 32 which receives the cleaning head 12 of the floor cleaner 10, and a support arm 33 against which the handle 16 of the floor cleaner 10 rests. The dock 30 further comprises a power connection 36 to mains electricity.

Figure 3:
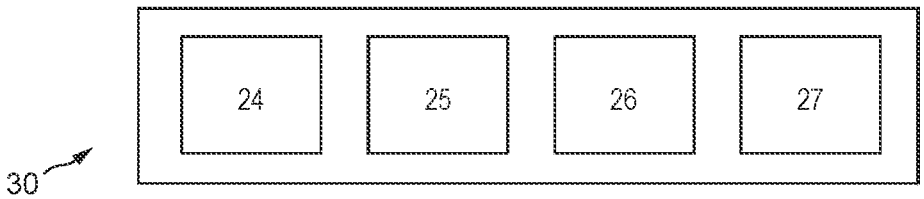
FIG. 3 shows a schematic representation of components of the dock shown in FIG. 2.

FIG. 3 shows some additional components of the dock 30. In particular, the dock 30 comprises a charging unit 24 connected to mains electricity via the power connection 36. The charging unit 24 is arranged to supply charge to a battery 29 of the floor cleaner 10, either by wireless charging or by wired charging (as schematically depicted in FIG. 2). The dock 30 also comprises a waste liquid tank 25, a cleaning fluid tank 26, and a control unit 27. The waste liquid tank 25 is arranged to receive waste liquid from the waste liquid reservoir of the floor cleaner 10. The cleaning fluid tank 26 is arranged to feed cleaning fluid into the cleaning fluid reservoir of the floor cleaner 10. The control unit 27 is arranged to control any active service functions of the dock 30, including the charging of the floor cleaner 10. Therefore, the dock 30 is able to perform several service functions on the floor cleaner 10, including charging the floor cleaner 10, emptying waste liquid from the floor cleaner 10, and refilling the floor cleaner 10 with cleaning fluid.

Figure 4:
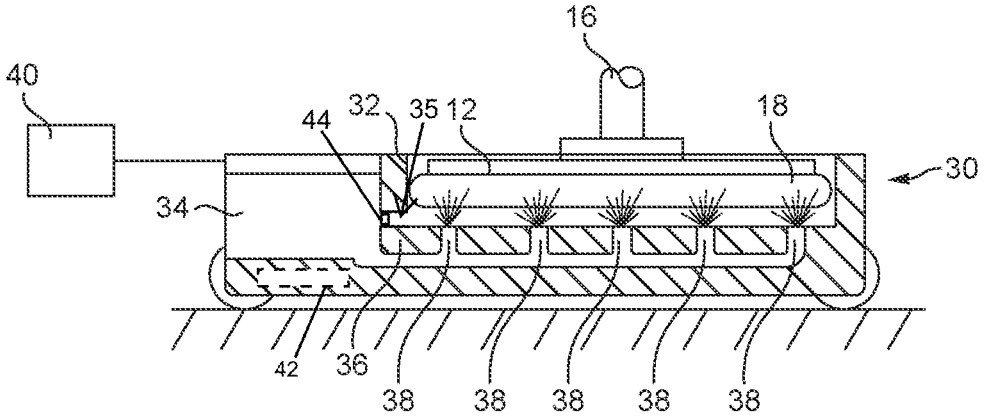
FIG. 4 shows a schematic cross-sectional view of a dock and floor cleaner.

FIG. 4 shows a cross-sectional view of the dock 30 with the floor cleaner 10 received in the dock 30. The cleaning head 12 is received within the receiving unit 32, such that the cleaning pads 18 are surrounded by the receiving unit 32. The dock includes a reservoir 34 in which a fluid is stored. The liquid may be water or a disinfecting liquid. A fluid passage 36 feeds the fluid from the reservoir 34 to a plurality of high-speed nozzles 38 located at the bottom of the receiving unit 32 and underneath the cleaning pads 18 when the floor cleaner 10 is inserted into the dock 30. A pump 40 is connected to the reservoir 34, and arranged to pump fluid via the fluid passage 36, through the high-speed nozzles 38, at a high pressure, such that the cleaning pads 18 are hit with a high speed spray. The high speed spray agitates the cleaning pads, such that dirt present on the cleaning pads 18 is removed. The liquid sprayed onto the cleaning pads 18 will fall to the bottom of the receiving unit 32, where a return fluid passage 35 channels the liquid back to the reservoir 34. A filter 44 removes any waste particles from the liquid prior to entry into the reservoir 34.

The dock 30 further comprises a heater 42 linked to the reservoir 34, such that the fluid in the reservoir 34 may be heated prior to being sprayed onto the cleaning pads 18. The pump 40 and the heater 42 are connected to and controlled by the control unit 27, which may activate the pump 40 and heater 42 in one or more cleaning modes. For example, the pump 40 may be intermittently activated to provide several distinct high speed sprays. Alternatively, the pump may be continuously activated to provide an extended and continuous high speed spray. The cleaning modes may include a "quick" clean intended for use of the floor cleaner 10, or a "deep" clean intended for use after use of the floor cleaner 10 has finished. The cleaning modes may be selected by a user interface which communicates with the control unit 27.

Whilst the present invention has been described and illustrated with reference to particular embodiments, it will be appreciated by those of ordinary skill in the art that the invention lends itself to many different variations not specifically illustrated herein. For example, rather than recirculating the liquid that is sprayed onto the cleaning pads 18, the liquid may be directed from the bottom of the receiving unit 32 into a separate waste liquid reservoir.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. A dock for receiving a floor cleaner, the dock comprising:

a receiving unit for receiving the floor cleaner, a reservoir for containing liquid, and a nozzle arranged to spray a floor cleaner received in the receiving unit with liquid from the reservoir such that an agitating cleaning effect is provided, wherein the dock is arranged such that the liquid sprayed on the floor cleaner returns to the reservoir for containing liquid.

2. The dock as claimed in claim 1, further comprising a heater, the heater arranged to heat the liquid being sprayed on the floor cleaner.

3. The dock as claimed in claim 1, further comprising a filter, the filter arranged to filter liquid that has been sprayed onto the floor cleaner.

4. The dock as claimed in claim 1, wherein the spray is arranged for intermittent operation, such that the floor cleaner may be sprayed on a plurality of occasions during a cleaning process.

5. The dock as claimed in claim 1, wherein the spray is arranged for continuous operation, such that the floor cleaner is sprayed only a single time during a cleaning process.

6. The dock as claimed in claim 1, further comprising a charging unit, the charging unit arranged to charge a battery of a floor cleaner received in the receiving unit.

7. The dock as claimed in claim 1, further comprising a cleaning fluid reservoir for supplying cleaning fluid to a floor cleaner received in the receiving unit.

8. A method of cleaning a floor cleaner comprising the steps of:

docking the floor cleaner with the dock as claimed in claim 1 such that the floor cleaner is received in the receiving unit of the dock, and spraying the floor cleaner with liquid from the reservoir such that an agitating cleaning effect is provided.

* * * * *